United States Patent [19]

Roy et al.

[11] Patent Number: 4,948,331

[45] Date of Patent: Aug. 14, 1990

[54] HIGH PRESSURE INDUSTRIAL TURBINE CASING

[75] Inventors: Daniel R. Roy, Carlisle; Wingming O. Chow, Fitchburg; William A. Schofield, Sterling, all of Mass.

[73] Assignee: General Electric Company, Schenectady, N.Y.

[21] Appl. No.: 387,204

[22] Filed: Jul. 31, 1989

[51] Int. Cl.[5] ..... F01D 17/00; F01D 25/24

[52] U.S. Cl. ..... 415/20; 60/691; 60/678

[58] Field of Search ..... 60/691, 654, 678; 415/20, 21, 22, 144, 145, 213.1

[56] References Cited

U.S. PATENT DOCUMENTS

| | | | |
|---|---|---|---|
| 2,303,190 | 11/1942 | Anderson | 415/20 |
| 2,823,891 | 2/1958 | Baker et al. | 415/144 |
| 3,289,408 | 12/1966 | Silvestri, Jr. | 60/678 |
| 3,877,231 | 4/1975 | Tinker | 60/691 |
| 3,966,355 | 6/1976 | Pierpoline | 415/144 |
| 3,995,430 | 12/1976 | Hoover, Jr. | 60/657 |
| 4,060,124 | 11/1977 | Tratz et al. | 165/110 |
| 4,177,387 | 12/1979 | Malone | 290/40 |
| 4,270,055 | 5/1981 | Ronnen et al. | 290/40 |
| 4,567,729 | 2/1986 | Roddis | 60/692 |
| 4,628,693 | 12/1986 | Riollet | 60/648 |
| 4,819,436 | 4/1989 | Ahner et al. | 60/678 |

FOREIGN PATENT DOCUMENTS

| | | | |
|---|---|---|---|
| 0090703 | 5/1984 | Japan | 415/144 |
| 0195403 | 2/1986 | Japan | 415/195 |
| 423763 | 2/1935 | United Kingdom | 415/14 |

*Primary Examiner*—Edward K. Look
*Assistant Examiner*—Hoang Nguyen
*Attorney, Agent, or Firm*—Nixon & Vanderhye

[57] ABSTRACT

A casing for a high pressure steam turbine is provided which is adapted to be stocked for subsequent customization. The casing is made as an incomplete casing with a closed chamber between an inner and outer wall and extending axially along a significant length of the casing. Taps for extraction or admission are subsequently provided by locating the axial locations which provide the desired pressures, machining a slot through the inner wall and an opening through the outer wall, and securing a fluid tight barrier between the walls adjacent the slot to separate the chamber in an additional chamber. Other aspects of the invention include providing for a controlled extraction with control means in the upper portion of the casing and extraction out of the lower portion. Additional features include axial ribs to abut and support the barrier, and provisions for making connections to the interior of the turbine casing.

41 Claims, 5 Drawing Sheets

HIGH PRESSURE INDUSTRIAL TURBINE CASING

BACKGROUND OF INVENTION

This invention relates to an improved high pressure turbine casing of the type used for steam turbines in steam turbine power generating systems or other turbine drive applications, and in particular, to a turbine casing that is readily adaptable to a plurality of different system configurations.

In general, a steam turbine power system or plant comprises a series connected arrangement of a steam generator which generates steam from water through heating such as by gas or oil, the steam turbine which converts the energy contained in the steam into rotary power, and an electric power generator or other drive equipment driven by the steam turbine. The steam turbine casing encloses stationary blades secured to the interior of the casing and rotating blades on the turbine shaft wherein the high pressure steam is permitted to expand through alternating arrays of stationary and rotating blades or stages to impart rotation to the shaft which is connected to drive the driven equipment.

The steam after passing through the turbine blades is exhausted through the turbine casing and conducted to a condenser for conversion back to water which is returned to the steam generator to complete the closed-loop fluid system.

The turbine casing is a high pressure casing which is typically cast from a steel alloy such as chromium molybdenum, which can withstand the high internal pressures which may exceed 1500 pounds per square inch. A particular steam generating system may include accessories such as one or more feedwater heaters which utilize steam extracted from the interior of the turbine casing to preheat the water being fed from the condenser to the steam generator. Industrial steam turbine power generating systems often require other steam extractions at selected or required steam pressure(s) from the turbine for use with associated industrial processes in the plant such as, for example, drying paper in a paper mill, or even steam for lower pressure associated steam turbines. Admission of steam from the steam generator through the inlet to the turbine casing must also be provided. In addition other plant processes may generate steam which can profitably be used by the steam turbine if admitted to the turbine at the appropriate pressure location. Since the pressure in a steam turbine decreases as it passes through the various turbine stages, different pressure taps are located axially along the turbine casing. Various system demands result in the need for turbine casings to meet various flow configurations, and to meet a plurality of variables such as condensing or non-condensing exhaust; straight through, or controlled extraction or controlled admission; and from zero to four uncontrolled extractions or uncontrolled admissions.

The result is that the turbine casing must securely contain the high pressure steam used to drive the turbine rotor while at the same time allow for a variety of flow configurations and axial taps to meet the specific customer applications, needs, and design. The requirement for a pressure secure casing has resulted in the costly custom casting of casings for each application after it has been defined. However, because of the demanding technical requirements and extremely large size of typical industrial turbine casings, the customized alloy steel casings have typically required up to seven months for delivery. Cycles of an additional six to seven months are typically required to do the necessary machining, assembly, and test of the complete steam turbine, resulting in a fourteen month turbine delivery cycle which is frequently not responsive to customer needs.

Casting a hole through a double walled chamber in a marine steam turbine has been done to enable the location of an uncontrolled extraction or admission from or to the interior of the turbine. However, the need for controlled extractions or admissions and customizing flexibility in the design of industrial turbine applications has not enabled such designs to be stockpiled and later customized to meet industrial requirements.

As a result, and notwithstanding the competitive pressures and customer demand to expedite the turbine delivery cycle, the need for custom high pressure turbine casings has continued to heavily contribute to the long steam turbine delivery cycle over the years. Efforts such as extensive overtime in the manufacturing cycle has greatly increased cost and lowered production efficiency. Attempts to standardize industrial turbine casings to enable use of a standard casing for different industrial customers and applications has proved to be unworkable because of the many variables involved. The steam turbine industry has not been able to effectively cut the long lead time required to fabricate high pressure turbine casings in advance of specific customer orders. Moreover, the high cost of fabricating such casings makes it extremely risky to commence such fabrication in advance of a firm contract with definitive specifications for a turbine system, such that proceeding on the basis of perceived customer needs in advance of such a contract entails great risk that either the potential customer requirements might change or that the potential customer might place its order with a competitor.

OBJECTS AND SUMMARY OF INVENTION

Accordingly, it is an object of the present invention to provide for pre-engineering high pressure industrial turbine casings to permit stocking of this long lead time component with customization at a later date.

It is a further object of the present invention to provide a high pressure turbine casing that is adaptable to customization to include a plurality of admissions or extractions.

It is a still further object of the present invention to provide a high pressure cast steel turbine casing that can be fabricated and subsequently adapted to a plurality of both controlled and uncontrolled admissions and extractions.

It is yet another object of the present invention to provide a high pressure turbine casing which is adapted to be stocked and customized to meet variable industrial customer requirements.

It is still yet another object of the present invention to minimize the time required upon receipt of an order to fabricate a steam turbine.

With the aforesaid objects in view, the present invention resides in the provision of a high pressure turbine casing such as a steam turbine casing, which is adapted to be fabricated in incomplete form and includes a closed chamber between an inner and outer wall and extending a substantial distance axially along the casing. The casing may be cast and stocked pending the definitization of the steam requirements for the turbine and the associated industrial process, at which time it may be customized by accessing the casing through the closed chamber at those locations which will provide desired or required steam pressure.

This is accomplished by locating one or more axial locations on the turbine at which the turbine in operation will provide the desired steam pressure and machining a slot through the inner wall and an opening through the outer wall at the selected locations and securing a steam-tight barrier between the inner and outer walls if required adjacent to the slot to separate the chamber into two or more chambers. Connections are then made at the selected locations. Controlled steam extraction or admission may then be accomplished through valves in the upper half of the turbine between the outside and inside walls of the casing at the axial locations.

BRIEF DESCRIPTION OF DRAWINGS

Referring to FIG. 1, a steam turbine system, which may be an electric power generating system is indicated generally as 10 and is shown to comprise a steam turbine 11 connected in series between a steam generator 12 and a condenser 13. The shaft 15 of the turbine 11 is connected to drive an electric power generator or other driven equipment 17 which in the case of an electric power generator provides electric power to the associated electrical load 19. Steam emerges from the steam generator 12 for admission to the steam turbine 11 at 14 and expands through alternating arrays of stationary blades 21 and rotating blades 22 within the turbine casing or shell 23 of steam turbine 11 in order to convert the energy of the steam to rotational mechanical energy to turn shaft 15 and generate electrical energy for electrical load 19. The steam is exhausted at 30 through the low pressure exhaust assembly 20 and is fed to the condenser 13 in order to restore the steam to the liquid state prior to its return to the steam generator 12 to complete the closed loop thermodynamic cycle.

Figure 1:
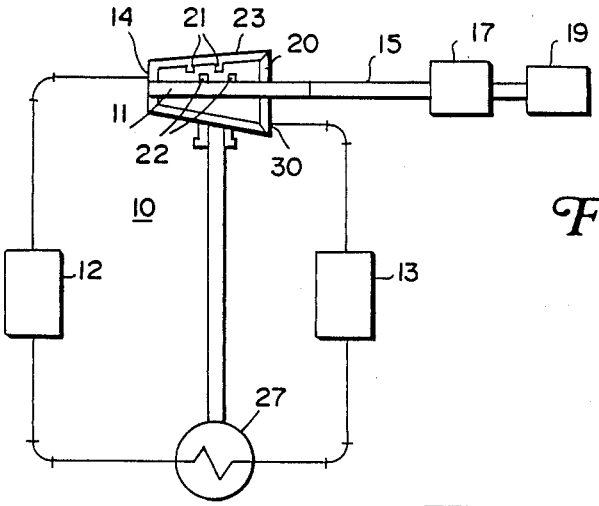
FIG. 1 is a schematic representation of a steam turbine system incorporating the present invention.

The overall efficiency of the electric power generating system 10 may be enhanced and the power generation made more economical if the temperature of the feedwater is raised prior to its return to the steam generator. This is commonly accomplished by the use of one or more feedwater heaters. The heat source for the single feedwater heater 27 shown in FIG. 1 is steam extracted from a predetermined location within the steam turbine 11. In addition, steam may also be extracted from other locations within the steam turbine 11 for additional feedwater heaters (which are normally uncontrolled extractions) or for other uses in the associated industrial process (which are usually controlled extractions or admissions). For example, a particular requirement for the associated process might be for steam at 600 pounds per square inch controlled and also at 200 pounds per square inch which might be obtained by taps at stage three and stage five respectively of the turbine. The application and requirements of the particular electric power generating system 10 determines how many such steam extractions and admissions are required, which must be controlled, and also the locations of such extractions and admissions to obtain the required steam pressures.

The turbine casing 23 must contain the high pressure steam within the casing and provide all openings for extractions and admissions, yet should be tight and essentially leak proof. The present invention takes these requirements into consideration while providing a casing design which is adaptable to a variety of extraction and admission configurations.

Figure 2:
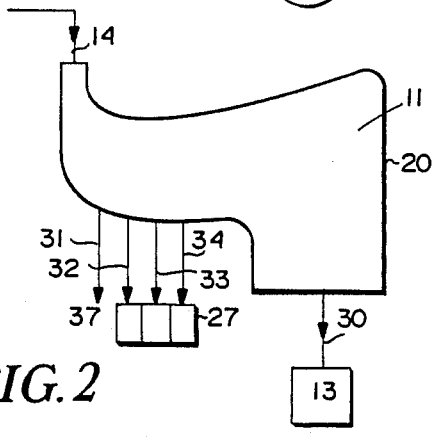
FIGS. 2 through 5 are schematic representations of examples of variable turbine casing requirements for which the present invention is applicable.

FIGS. 2 through 5 schematically show a variety of extraction and admission designs as examples of the variety of configurations to which the present invention is adaptable. Referring to FIG. 2, a straight condensing steam turbine is illustrated. The inlet steam 14 is provided to steam turbine 11 and after its energy is converted to rotary energy as described above, the steam is exhausted through exhaust 30 to the condenser 13. Also shown are the uncontrolled extractions 31, 32, 33 and 34 which can be fed to the feedwater heaters 27 or associated industrial process 37. In a multistage turbine, that is, one having multiple sets of cooperating stationary blades 21 and rotating blades 22 spaced along the axis of the turbine between the inlet steam 14 and the exhaust 30, the pressure of the steam will decrease as it progresses through the multiple stages from the inlet 14 to the exhaust. As a result, extractions taken downstream from the inlet point will be at progressively lower pressures such that the axial position of the extraction may be selected to provide the desired steam pressure for use in associated industrial processes. The extractions may be, for example, after stage two, stage four, and stage five of the steam turbine 11 to provide the various desired steam characteristics to the associated process. As a result, depending on the nature of the associated process 37 and also of the steam turbine system 10 (e.g. on the number of feedwater heaters) it can be seen that the number and positioning of the extractions and admissions will vary from installation to installation, and system to system. As a result, the turbine casing 23 must be customized for each such installation and system.

Figure 3:
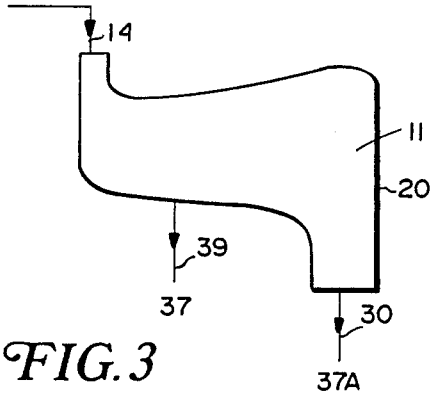

Referring next to FIG. 3, a straight non-condensing steam turbine is shown. The inlet steam 14 is provided to the steam turbine 11 as in FIG. 1. However, the non-condensing exhaust 30 flows to the associated industrial process 37A. Turbine casing connection 39 may be an uncontrolled admission or extraction from the process 37.

Figure 4:
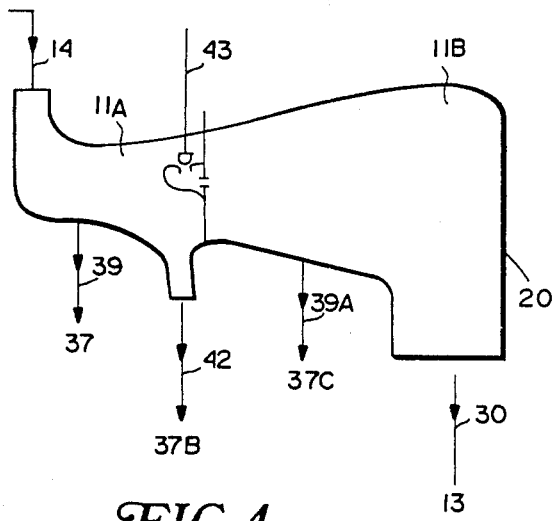

Referring next to FIG. 4. FIG. 4 shows an automatic extraction/admission condensing turbine in which 11A and 11B represent two separately controlled sections in series in a single casing of the steam turbine 11 operating or running like two steam turbines in series, each of which may contain a plurality of stages. An uncontrolled extraction or admission 39 to or from the associated process 37 is shown for controlled Section 11A, and the steam is exhausted through exhaust 30 to the condenser 13. In addition, a controlled extraction/admission 42 is provided between sections 11A and 11B through control valve 43 to or from the associated process 37B, and an uncontrolled extraction or admission 39A from section 11B is also provided to the industrial process 37C.

Figure 5:
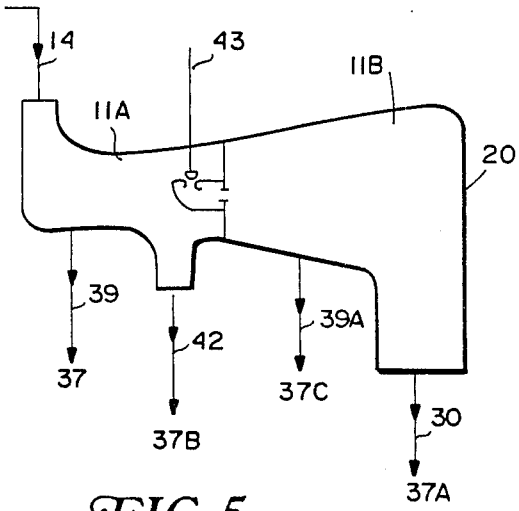

Referring next to FIG. 5. FIG. 5 shows a two section automatic or controlled extraction or admission non-condensing system in which the exhaust 30 is connected to the associated process 37A. As in FIG. 4, the two sections 11A and 11B of the steam turbine 11 each have an associated uncontrolled extraction or admission, and a controlled extraction or admission 42 between sections 11A and 11B to or from the associated process 37B through control valve 43. However, the exhaust 30 is to the associated process.

From the above discussions regarding FIGS. 2 through 5, it can be appreciated that a particular steam turbine system 10 and its associated industrial process 37 each may require different yet specific extractions and admissions making it impractical to stock expensive turbine casings 23 configured to a particular use. The variables in customization requirements thus have made stocking of such turbine casings impractical with prior art designs.

Figure 6A:
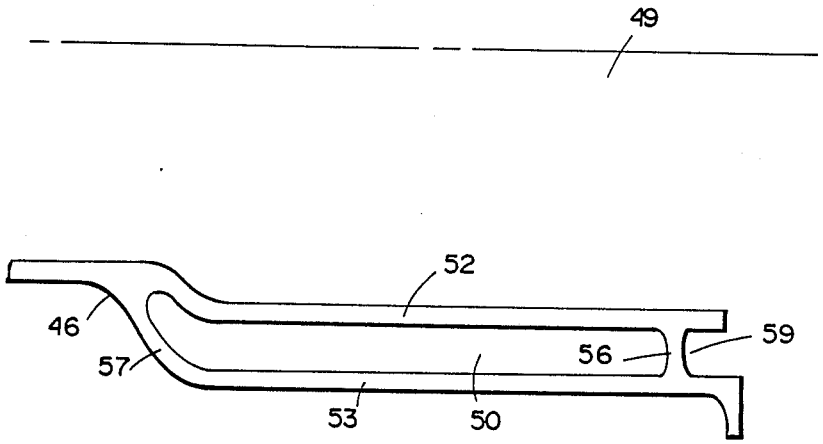
FIGS. 6A and 6B show a steam turbine lower half casing in accordance with the present invention including a front view in cross section, and a side view of the casing. The casing is shown in the incomplete state in which it would be stocked.
Figure 6B:
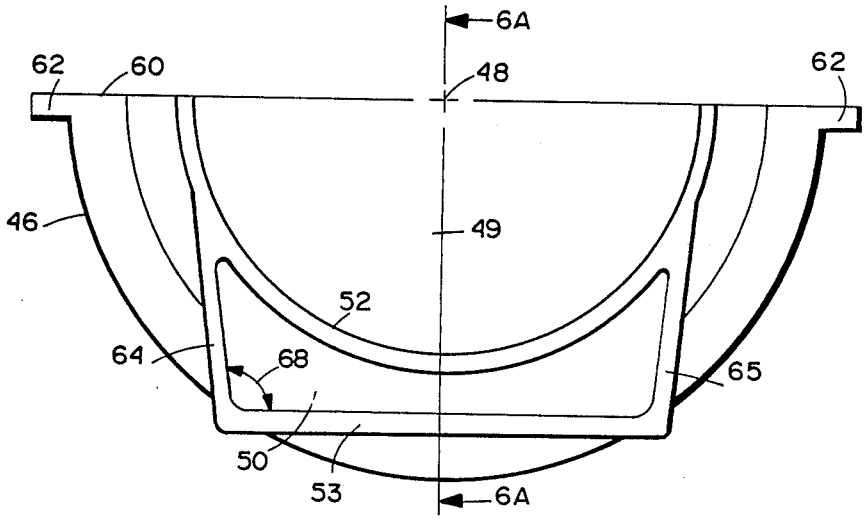

The present invention enables stocking of specially designed turbine casings including provisions which enable subsequent customized extractions and admissions. FIGS. 6A and 6B provide a more detailed showing of this aspect of the present invention. Referring to FIGS. 6A and 6B, there is shown a portion of the lower half 46 of the turbine casing 23. The turbine casing 23 is commonly divided horizontally along the turbine axis 48 into an upper half-cylindrical member 66 (shown in FIG. 10 and discussed below) and the lower half-cylindrical member 46 to allow assembly of the turbine including the stationary stator blades 21, rotating blades 22, the shaft 15 of the rotor (not shown) and associated components such as the steam nozzle bearing diaphragms (not shown) onto the lower half 46 of the casing. The upper half of the casing 66 may thereafter be lowered to enclose the turbine components and the two halves of the casing 46 and 66 are bolted together to provide along with exhaust assembly 20 a sealed casing to contain and utilize the steam introduced to impart the rotational drive to the generator 17. FIG. 6B shows the end of the turbine casing 46 while FIG. 6A is a cross sectional view of the casing 46 along the line AA. The high pressure turbine casing 46 is cast from chromium molybdenum alloy steel or carbon steel. The area 49 represents the location of the internal steam turbine rotor (not shown) and diaphragms (not shown) whereas the area 50 represents the area along the lower portion of turbine casing 46 parallel to the axis 48 of the steam turbine 11. The area 50 is a cavity or chamber extending along the circumference of the turbine casing 46 and defined by an inner wall 52 which may be the cylindrical casing wall and an outer wall 53 forming the chamber 50 therebetween which is closed at the ends by end walls 56 and 57. End wall 56 is substantially perpendicular to the turbine axis 48 and positioned inward from the rear surface of the end of the turbine casing 46 forming a recess 59. As shown in FIG. 6B the chamber 50 extends generally for a significant length or a substantial portion along the bottom of the turbine casing 23. The inner or upper wall 52 is generally formed as an arcuate portion of a cylindrical surface about the turbine axis 48. The outer wall 53 is substantially flat and parallel to the mating surface or seam 60 to which the upper half 66 of the casing shown in FIG. 10 is secured by bolts along flanges 62 when the turbine casing is sealed. The chamber 50 is sealed and further defined by depending or side members 64 and 65 as best shown in FIG. 6B. Side members 64 and 65 extend from the outer wall at an angle 68 which is greater than ninety degrees. The inner wall 52 of chamber 50 thus conforms to the inner cylindrical surface of the turbine while the outer wall or surface 53 is horizontal to facilitate customization and connections as is described in more detail below.

Figure 7A:
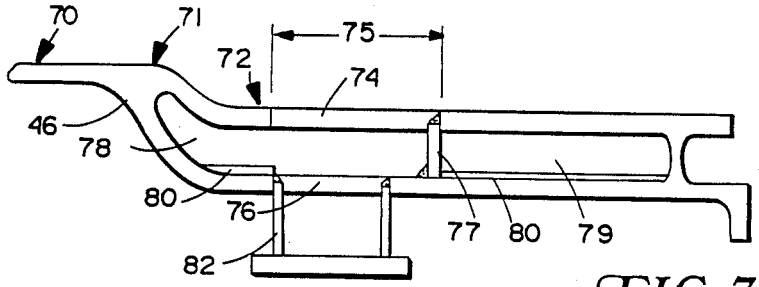
FIGS. 7A and 7B show the customization of the turbine casing lower half of FIGS. 6A and 6B to accommodate controlled steam extraction or admission at stage three of the turbine with an additional chamber for controlled or uncontrolled extraction or admission.
Figure 7B:
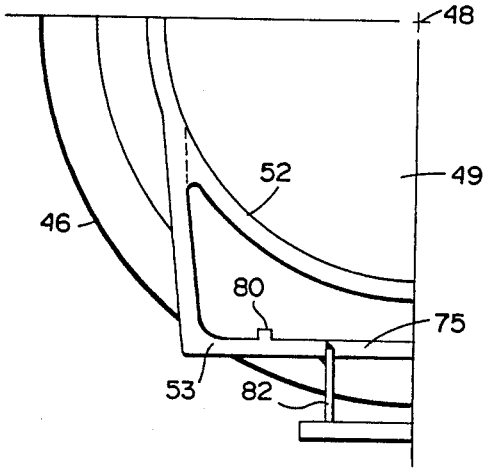

Referring next to FIGS. 7A and 7B. FIGS. 7A and 7B show the location of the ends of the stationary blades for stages one, two and three of the turbine 11 relative to the lower half 46 of the turbine casing 23, which are 70, 71 and 72 respectively. An entrance hole or slot 74 having an axial dimension 75 is cut, transverse to the turbine axis 48 along the inner wall 52 beyond or downstream from the stage 3 rotor wheel thus connecting the interior 49 of the steam turbine 11 to the chamber 50. A typical slot 74 is in the order of 20 inches wide along the axial direction of the turbine and may extend up to a 50 inch arc on the turbine wall. The width of the slot is determined by the volume of the required steam flow through it, such that higher volumes would require larger slots. An uncontrolled extraction slot may however be as little as 2 inches in the axial direction. An exit hole or passageway 76 of generally circular configuration is machined, that is, cut or drilled by mechanical, laser or other means, through the outer wall 53 opposite the slot 74 to provide a passageway from the interior to the exterior of the turbine casing. A barrier wall 77 shaped to conform to the cross section of chamber 50 is welded or otherwise attached to the casing in the slot 74 along one edge thereof to separate the cavity into chamber 78 and chamber 79. A piping flange 82 welded to the outer wall 53 and surrounding the exit hole 76 provides for customer connection of controlled extraction or admission through chamber 78. A pair of spaced support ribs 80 extend axially along the inside surface of the outer wall 53. The barrier wall 77 abuts against the section of axial rib 80 which remains after the slot 74 and hole 76 have been machined and the rib 80 below slot 74 removed. Thus, the barrier wall 77 abuts and is supported along the slot 74 at its upper edge along inner wall 52, and abuts and is supported by ribs 80 at points along its lower edge on outer wall 53 after which it is welded in place to form the steam-tight chambers 78 and 79. Chamber 79 is available for uncontrolled extraction or admission from stage four or any other downstream stage enclosed or encircled by the chamber 79; and, if used, a piping flange 82 would be provided along with a mating hole and slot similar to hole and slot 76 and 74 respectively. The customization of chamber 50 shown in FIG. 7B in the manner described above could provide controlled extraction or admission out or in to stage three of the steam turbine 11 with uncontrolled extraction or admission from, or to, stage four or any other stage enclosed or encircled by chamber 79.

The casting of the chamber 50 may be accomplished through use of a sand mold shaped into the form of the chamber and supported within the casing mold by supports which extend through the space in the mold which defines the inner wall 52 and/or the outer wall 53 during the casting process. Holes, which may result from removal of the supports, and/or are then drilled through walls 52 and/or 53, allow removal of the sand after the casting has cooled. These holes are subsequently sealed by welding during the finishing operations on the rough casting.

Alternately, the casing half 46 may be cast in a substantially half-cylindrical form providing the inner wall 52 while the outer wall 53, end walls 56 and 57, and side members 64 and 65 could be added, such as by welding, to form a similar structure which could be retained in stock and subsequently customized at a later date in the manner as described above and/or below.

Figure 8:
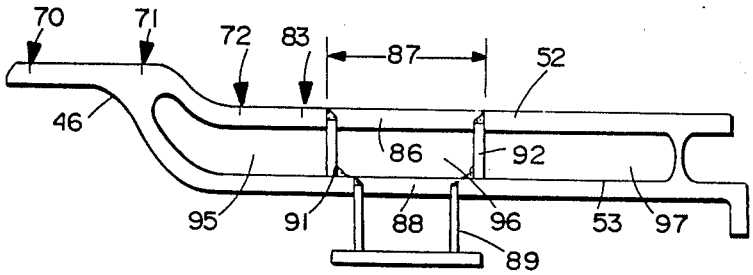
FIG. 8 shows the customization of the turbine casing of FIGS. 6A and 6B to accommodate extraction or admission at stage four of the turbine, with two additional chambers available for controlled or uncontrolled extraction or admission.

FIG. 8 shows a customization of the lower half 46 of turbine casing 23 to enable extraction or admission at stage four of the steam turbine 11. The end of stage four is shown by 83. A slot 86 with a width 87 is cut into the inner wall 52 and a mating hole 88 is cut or drilled into the outer wall 53 with a surrounding piping flange 89 in a manner similar to that described in connection with FIGS. 7A and 7B above. It is possible to provide an outer wall 53 of sufficient thickness to enable threads to be tapped through the wall for direct connection of piping. In FIG. 8 the two separate barrier walls 91 and 92 shaped to conform to, and secured between, the inner wall 52 and outer wall 53 along the ends of slot 86 in the manner described in connection with FIGS. 6A and 6B above form three chambers from the chamber 50, namely a first chamber 95 to the left of barrier wall 91, a second chamber 96 between barrier wall 91 and barrier wall 92, and a third chamber 97 to the right of barrier wall 92. Chamber 96 provides for a controlled stage four extraction or admission. Chamber 95 provides for uncontrolled extraction or admission from either stage two or stage three. Chamber 97 provides for uncontrolled extraction or admission from stage five or any other downstream stage enclosed or encircled by chamber 97.

Figure 9:
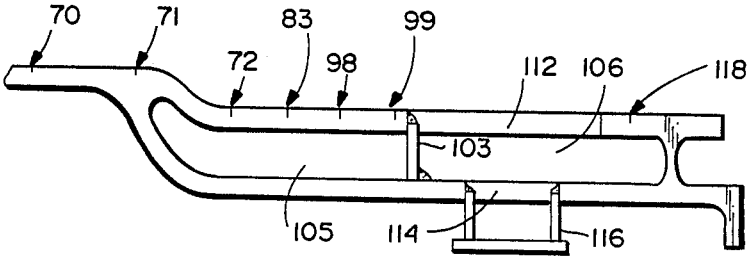
FIG. 9 shows the customization of the turbine casing of FIGS. 6A and 6B to accommodate a controlled extraction or admission at stage 6 of the turbine, with an additional chamber available for controlled or uncontrolled extraction or admission.

The same customization approach can be used for the controlled extraction or admission regarding stages 5, 6 or 7. FIG. 9 shows the controlled extraction or admission out of stage 6. Referring to FIG. 9, the stage 5 location is indicated by 98 and the stage 6 location is indicated by 99. In order to provide for the controlled extraction or admission for stage 6 the barrier 103 is provided and secured in the manner described in connection with FIG. 7A above with the barrier positioned just after the stage 6 position of the steam turbine 11. A slot 112, matching hole 114 and piping flange 116 is provided in chamber 106, all as described in connection with FIG. 7A above. The location of stage seven is indicated by 118.

Figure 10A:
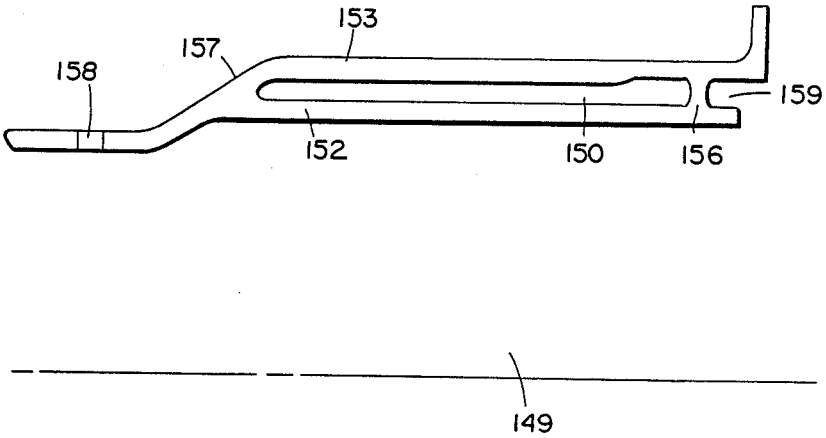
FIGS. 10A and 10B show the upper half of a turbine casing that would mate with the type shown in FIGS. 6A and 6B to accommodate a controlled extraction or admission.
Figure 10B:
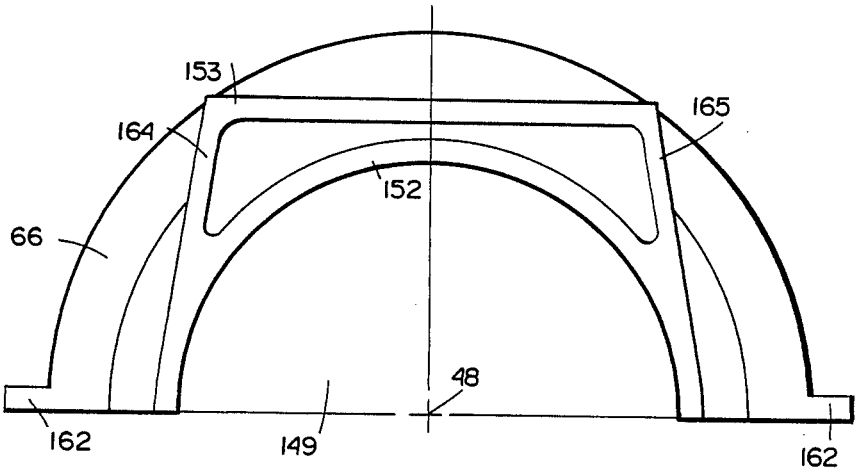

The upper half 66 of the turbine casing 23 is shown in FIGS. 10A and 10B in the condition in which it is cast and stocked. Referring to FIGS. 10A and 10B, there is shown a cavity 150 formed by the inner wall 152 and the outer wall 153, and including end walls 156 and 157 and depending side members 164 and 165 at an angle greater than ninety degrees from the outer wall 153. The inner wall 152 and the outer wall 153 are configured in the manner described in connection with FIGS. 6A and 6B above, but extending upward from the flange 162 rather than downward. The various turbine stages such as stage one, two or three are spaced axially along the turbine such that the steam operating characteristics is essentially the same at the same axial distance whether at the top or bottom of the turbine.

The upper half 66 of the turbine casing 23 may for a given type of steam turbine include the main steam inlet 158 for connection to the steam generator 12 cast as part of the casing. Since this connection and its location on the casing can be the same for a number of applications, it does not have to be custom located as other admissions.

Figure 11:
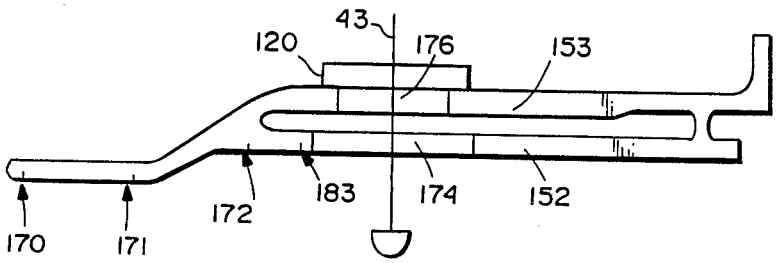
FIG. 11 shows the customization of the turbine upper half casing of FIGS. 10A and 10B to accommodate a controlled extraction or admission at stage four of the turbine.

FIG. 11 is one additional example of a customized turbine casing to show the slot and hole configuration for the upper half 66 of the turbine casing 23 for a controlled extraction or admission located after stage four. Referring to FIG. 11 the position of stages 1, 2, 3 and 4 at the upper half 66 of turbine casing 23 are shown by 170, 171, 172 and 183 respectively. The rectangular hole 176 is cut into the outer wall 153 and the slot 174 is cut into the inner wall 152. The control valve 43 for the controlled extractions or admissions shown schematically in FIG. 11 extends through bolted-on cover 120 and is conveniently mounted in the passageway formed between the inner wall 152 and outer wall 153 of the casing 23. Mounting the control valves in the upper half 66 of the casing facilitates easy access.

The control valves for an automatic controlled extraction or admission are typically spool or poppet valves (not shown) which extend radially around the inner region of the upper half 66 and lower half 46 of the turbine casing 23 and are actuated to vary the area of the valve opening or passage available for steam flow past the spool valves to the next stage downstream in the steam turbine 11. They are actuated by a control system (not shown) in the manner well known in the art to maintain a constant pressure despite variations in the turbine load. For example, if the valves are provided for automatic extraction of 200 lbs. per square inch steam, the control system will vary the valve opening to provide steam at that controlled pressure out of the exit hole, such as 76 in FIG. 7A in the lower half 46 of the turbine casing 23. While the operating valves are conveniently located in the upper half 66 of the casing they can also be positioned in both the upper and lower halves.

Thus, there is a separate chamber formed or provided in both the upper and lower halves of the casing 23 to accommodate an automatic or controlled extraction or admission, while an uncontrolled extraction or admission requires only a chamber in the lower half 46 of the casing 23 formed by the installation of a barrier wall 77 at the appropriate axial location in the manner described above. The chambers are provided at the axial location which will provide the desired steam pressure, or at which the steam pressure is required. However, in the case of the uncontrolled extraction or admission the pressure will vary from and around that desired or calculated with variations in the system, such as load on the steam turbine. As pointed out above, the width of the associated slot such as 75 will vary depending on the volume of steam to be extracted.

Thus, the chamber 50 shown in FIG. 6 can readily provide access for one controlled extraction or admission together with a plurality of uncontrolled extractions or admissions. From the above description it can be seen that the invention enables the stocking of high pressure industrial turbine casings which can relatively quickly be customized to provide controlled or uncontrolled extraction or admission to the required and/or desired regions of the steam turbine in order to meet the power plant, or associated industrial process, requirements. This can effectively cut down the long lead time otherwise required to secure such casings. Moreover, the castings which are stocked are standardized, providing casting cost savings.

While the present invention has been described with respect to certain preferred embodiments thereof, it is to be understood that numerous variations in the details of construction, the arrangement and combination of parts, and the type of materials used may be made without departing from the spirit and scope of the invention. For example, customizable chambers may be provided along the sides of the steam turbine in addition to, or in lieu of, the bottom.

Also, while only a single automatic or controlled extraction or admission has been described in the various examples of applications of the present invention discussed above, it is to be appreciated that the same principles can be applied to turbines with two or more controlled extractions or admissions. In such cases barrier walls similar to 77 in FIG. 7A would be provided in the upper half 66 of the turbine casing 23 to form two or more chambers from chamber 150. In addition, the present invention is applicable to turbines having any number of stages since the length of chambers 50 and 150 would be designed to span all of the stages.

By way of further example, while the invention has been described a steam turbine casing, it is also applicable to other applications, such as for use in a high pressure gas turbine where it may be desired or required to provide for the selective extraction or admission of the heated gas at various axial locations on the casing.

What we claim is:

1. A method of fabricating a high pressure turbine casing for a turbine driven by a high pressure fluid, and adapted to be stocked for subsequent customization to provide selected fluid characteristic when they become known, comprising the steps of:

forming a general purpose incomplete casing having a closed chamber between an inner and outer wall and extending axially along a significant length of said casing;

retaining said casing in stock pending definitization of the fluid requirements of said casing for its application; and subsequently customizing said casing by;

locating one or more axial locations at which the high pressure fluid will in operation provide desired characteristics;

machining a slot through said inner wall and an opening through said outer wall at said one or more axial locations;

securing one or more barriers between said inner and outer walls adjacent said one or more slots to separate said chamber into one or more additional chambers; and providing connection means at said one or more locations from the outside of said casing.

2. The method of claim 1 wherein said inner wall is formed in a curve as part of a turbine casing having a substantially circular cross section, and said outer wall is substantially flat.

3. The method of claim 1 wherein said casing is cast in two members, each comprising substantially half of said casing.

4. The method of claim 3 wherein a controlled extraction includes extracting the fluid adjacent a barrier from said one of two members which includes said barrier, and providing control means in the other member.

5. The method of claim 3 wherein said casting is formed of steel, and a main steam inlet passage is cast in one end region thereof, said end region being separate from said chamber.

6. The method of claim 5 wherein one or more ribs are provided extending axially along the interior of said outer wall to abut and provide support to said barrier.

7. The method of claim 1 wherein said outer wall is separately secured to said casing.

8. A casing for use in a high pressure industrial steam turbine utilized in an associated industrial process, and requiring customized steam extraction or admission taps along an intermediate portion of the axial length of said turbine at one or more pressures which are lower than that provided at the main steam inlet of the steam turbine for use in the industrial process and for feedwater heaters, and having components such as blades assembled within the interior of said casing comprising:

a first casing member forming a substantial portion of an enclosure for the high pressure end of the steam turbine along the rotational axis thereof;

a second casing member forming the remainder of an enclosure for the high pressure end of the steam turbine along the rotational axis thereof and adapted to be secured to said first casing to enclose the turbine components;

at least one of said casing members being provided with integral customizing means to facilitate the customization of said at least one casing member at a later time to adapt the casing to a variety of extraction and admission configurations;

said customizing means including:

an outer wall extending a significant length axially along and spaced from the inner wall of said casing to form a closed chamber therebetween;

said inner casing wall and outer wall separating the interior from the exterior of said casing to facilitate the subsequent addition of one or more steam taps;

the subsequent addition of one or more of said steam taps including one or more barriers secured between said inner and outer walls at axial positions which provide the desired steam pressure taps; and a passageway through said inner and outer walls in the region of each of said one or more barriers.

9. The turbine casing of claim 8 wherein said inner wall is curved and forms a part of a substantially circular cross section turbine casing.

10. The turbine casing of claim 9 wherein said outer wall is attached to said inner wall by a pair of opposed end walls.

11. The turbine casing of claim 10 wherein said passageway through said inner wall is an arcuate slot transverse to the axis of said casing.

12. The turbine casing of claim 11 wherein said one or more barriers conform to the cross section of said chamber and is secured thereto.

13. The turbine casing of claim 12 wherein said one or more barriers each divide said chamber into one additional chamber.

14. The turbine casing of claim 13 wherein said casing includes a main steam inlet passage integral with, and positioned in, one end region thereof which is separate from said chamber.

15. The turbine casing of claim 10 wherein both said first casing member and said second casing member include at least one customizing chamber means.

16. The turbine casing of claim 15 wherein a controlled steam tap is provided including valve control means in said customizing chamber of second casing member.

17. The turbine casing of claim 16 wherein said controlled steam tap provides steam extraction and comprises means to maintain the pressure of the extracted steam at a predetermined pressure, and wherein the steam passes through said passageway adjacent a barrier in said first casing member.

18. The turbine casing of claim 11 wherein said passageway through said outer wall comprises a hole, and the axial location of said passageway determines the approximate steam pressure at said passageway during operation of the steam turbine.

19. The turbine casing of claim 18 wherein the turbine is a multi-stage turbine and said axial location determines which turbine stage provides the steam pressure at said controlled tap.

20. A casing for use in a turbine rotatably driven about its axis by a high pressure fluid such as steam and in which the fluid characteristics vary along the axial length thereof comprising:

a closed chamber formed between said casing and an outer wall spaced from said casing;

said chamber extending a significant length axially along said casing to be adjacent to varying fluid characteristics within the turbine in response to fluid flow through the turbine; and at least one barrier shaped to conform to and positioned across the cross section of said chamber in a plane transverse to the rotational axis of the turbine and adapted to be added to said chamber at a later time to divide said chamber into an additional chamber; and a slot is provided through said inner wall, and a passage is provided through said outer wall adjacent to said barrier;

said one or more barriers being provided at one or more selected axial locations to provide selected fluid characteristics at said selected axial locations during operation of the turbine.

21. The turbine casing of claim 20 wherein said inner wall is curved and extends along an arc which surrounds a portion of said rotational axis of said turbine.

22. The turbine casing of claim 21 wherein said turbine is a multi-stage turbine and said axial location determines which turbine stage is proximate to the selected axial location.

23. The turbine casing of claim 22 wherein said outer wall is configured to facilitate the securing of piping flanges surrounding said passageway through said outer wall.

24. The turbine casing of claim 21 wherein one or more ribs are provided extending axially along the interior of said outer wall to abut and provide support to said barrier.

25. The turbine casing of claim 21 wherein said casing and said outer wall are cast as an integral unit.

26. The turbine casing of claim 23 wherein said outer wall is substantially flat and substantially horizontal when said turbine casing is assembled.

27. The casing of claim 26 wherein the cross section of said chamber in a direction perpendicular to said axis is substantially a frusto-trapezoid with an inwardly curving base.

28. The turbine casing of claim 21 wherein said outer wall is of sufficient thickness to enable threads to be provided in said passageway through said outer wall for the threaded connection of said passageway to the outside of said casing.

29. The turbine casing of claim 21 wherein said outer wall is separately secured to said casing.

30. A method of fabricating a high pressure rotating industrial multi-stage steam turbine casing for a turbine driven by high pressure, steam and adapted to be stocked for subsequent customization to provide one or more selected steam pressures for an associated industrial process comprising the steps of:

casting a general purpose incomplete first casing member configured to be combined with a second casing member to surround the rotating member of the turbine, and including a chamber between an outer and inner wall extending a significant length axially along said casing member;

retaining said casing members in stock pending definitization of the steam requirements of said casing for its industrial application including a determination of the extraction and admission requirements; and subsequently customizing said casing by;

locating one or more axial location along said chamber at which the high pressure steam will in operation be at the desired steam pressure after passing through one or more turbine stages;

machining a slot in said inner wall and an opening in said outer wall at said one or more axial locations; and securing a barrier between said inner and outer walls adjacent said slot to separate said chamber into an additional chamber;

whereby a passageway is provided through said inner and outer walls in the region of said barrier.

31. The method of claim 30 comprising the additional step of securing means to said second casing member to facilitate the controlled extraction of steam from one of said axial locations in said first casing member.

32. The method of claim 31 wherein said casing is cast from steel.

33. The method of claim 31 comprising the additional step of providing a main steam inlet integral with, and part of, said casting and extending from the exterior to the interior of said casing in an end region which is separate from said chamber.

34. The method of claim 33 wherein said casting step comprises casting substantially one half of the casing, and including an axial extending flange in said casting to facilitate assembly of said casing to substantially the other half of said casing.

35. The method of claim 33 comprising the additional step of securing said axially extending flange to a cooperating member on the substantially other half of said casing to provide a steam-tight casing for the high pressure end of the turbine.

36. The method of claim 30 wherein said outer wall is separately secured to said casing.

37. The method of claim 30 wherein said outer wall is of sufficient thickness to enable the subsequent threading of said openings to provide a connection of said passageway to the outside of said casing.

38. A method of fabricating a high pressure rotary industrial multi-stage steam turbine casing for a turbine driven by high pressure steam and adapted to be stocked for subsequent customization to provide one or more selected steam pressures for an associated industrial process comprising the steps of:

casting a general purpose incomplete first casing member configured to be combined with a second casing member to surround the rotating member of the turbine, and including a chamber between an outer and inner wall extending a significant length axially along said casing member and further including an axial extending flange in said casting to facilitate assembly of said casing to substantially the other half of said casing;

retaining said casing members in stock pending definitization of the steam requirements of said casing for its industrial application including a determination of the extraction and admission requirements; and subsequently customizing said casing by;

locating one or more axial locations along said chamber at which the high pressure steam will in operation be at the desired steam pressure after passing through one or more turbine stages;

machining an opening in said inner wall and an opening in said outer wall at said one or more axial locations; and securing means to said second casing member to facilitate the controlled extraction of steam from one of said axial locations in said first casing member.

39. The method of claim 38 wherein said casting step comprises casting a main steam inlet integral with and part of said casting extending from the exterior to the interior of said casing in an end region which is separate from said chamber.

40. The method of claim 39 comprising the additional step of securing said axially extending flange to a cooperating member on the substantially other half of said casing to provide a steam-tight casing for the high pressure end of the turbine.

41. The method of claim 38 wherein after said machining steps, at least one barrier wall is secured in place in said chamber to divide said chamber into a plurality of subchambers.

* * * * *